US009782025B2

(12) United States Patent
Watson

(10) Patent No.: US 9,782,025 B2
(45) Date of Patent: Oct. 10, 2017

(54) AMBIENT SOUND-ISOLATING PILLOW

(71) Applicant: Robert Joseph Watson, Barrington, NH (US)

(72) Inventor: Stone Joseph Watson, Barrington, NH (US)

( * ) Notice: Subject to any disclaimer, the term of this patent is extended or adjusted under 35 U.S.C. 154(b) by 717 days.

(21) Appl. No.: 13/650,691

(22) Filed: Oct. 12, 2012

(65) Prior Publication Data

US 2014/0101854 A1 Apr. 17, 2014

(51) Int. Cl.
*A47G 9/10* (2006.01)

(52) U.S. Cl.
CPC ..... *A47G 9/10* (2013.01); *A47G 9/1045* (2013.01); *A47G 2009/1018* (2013.01)

(58) Field of Classification Search
CPC .. A47G 9/10; A47G 9/1045; A47G 2009/006; A47C 7/383; H04R 5/023
USPC ..... 5/636, 639, 645, 904
See application file for complete search history.

(56) References Cited

U.S. PATENT DOCUMENTS

| | | | | |
|---|---|---|---|---|
| D214,302 | S * | 6/1969 | Barber | D6/601 |
| 4,783,865 | A * | 11/1988 | Stotler | 5/424 |
| D381,232 | S * | 7/1997 | Jansson | D6/596 |
| 6,010,192 | A * | 1/2000 | King | 297/397 |
| 6,668,407 | B1 * | 12/2003 | Reitzel | 5/656 |
| 7,685,661 | B2 * | 3/2010 | Popilek et al. | 5/639 |
| 8,584,285 | B1 * | 11/2013 | Sipherd | 5/640 |
| 8,590,536 | B2 * | 11/2013 | Tullous | 128/845 |
| 2005/0050636 | A1 * | 3/2005 | Setokawa | 5/636 |
| 2008/0034505 | A1 * | 2/2008 | Thomas | 5/655 |
| 2008/0066235 | A1 * | 3/2008 | Rubio | 5/636 |
| 2011/0235832 | A1 * | 9/2011 | Riopel | 381/300 |
| 2013/0113262 | A1 * | 5/2013 | Nam | 297/397 |

* cited by examiner

*Primary Examiner* — David E Sosnowski
*Assistant Examiner* — Myles Throop
(74) *Attorney, Agent, or Firm* — GTC Law Group PC & Affiliates

(57) ABSTRACT

An integrated ambient sound-isolating pillow composed of comfortable material such as memory foam may be configured as a one-piece pillow for long term resting (e.g. overnight sleeping) use. A one-piece ambient sound-isolating pillow may include a head cradling portion that provides comfortable support for a person's head while cradling at least the sides of the person's head so that a sound-isolating portion of the pillow acts as an ambient sound shield to the person's ears.

20 Claims, 4 Drawing Sheets

AMBIENT SOUND-ISOLATING PILLOW

BACKGROUND

Field

This disclosure relates to reducing ambient sound for a resting person.

Description of the Related Art

Conventional pillows do not offer much in the way of sound isolation. Earplugs may be uncomfortable and do not provide any means for selectively sending audio to a user. Multi-part noise reducing/cancelling systems typically involve some form of attachment to the user's head that may be uncomfortable for long-term use.

SUMMARY OF THE INVENTION

An integrated ambient sound-isolating pillow composed of comfortable material such as memory foam may be configured as a one-piece pillow for long term resting (e.g. overnight sleeping) use. A one-piece ambient sound-isolating pillow may include a head cradling portion that provides comfortable support for a person's head while cradling at least the sides of the person's head so that a sound-isolating portion of the pillow acts as an ambient sound shield to the person's hears.

The ambient sound-isolating pillow may be configured with earphone and/or loudspeaker recesses into which earphones and/or loudspeakers may be placed respectively for enabling the pillow user to listen to audio of his/her choosing while blocking out a significant portion of ambient sound.

Methods and systems of a isolating ambient sound with a pillow may include a pillow with a head support portion that is shaped to cradle the back and sides of a head of a person, a sound-isolating portion disposed relative to the head support portion to facilitate shielding at least the ears of the person from ambient sound with the head support portion and the sound-isolating portion being integrated into a one-piece pillow. The one-piece pillow may comprise memory foam. The head support portion may comprise a pliable surface for resting the back of a person's head and a curvilinear upper surface that is substantially orthogonal to the pliable surface for cradling at least the sides of a person's head.

The sound-isolating pillow may further include recesses in the curvilinear upper surface disposed to facilitate placing earphones in close proximity to the person's ears.

The sound-isolating portion of the pillow may comprise a region that extends outward from the upper surface of the head support portion and forms a sound-reducing barrier between a person's ears and the ambient.

The sound-isolating pillow may further include recesses in an outer surface of the sound-isolating portion that is opposite the upper surface; the recesses may be configured for disposing loudspeakers to facilitate propagating sound from the loudspeakers to the person's ears through the sound-isolating portion. The sound-isolating portion may comprise pliable foam.

In an embodiment, the one-piece pillow is constructed by integrating the sound-isolating portion with a pliable panel that facilitates cradling the back of a person's head. In such an embodiment, the sound-isolating portion may comprise a single formation of pliable foam.

Methods and systems of isolating ambient sound with a pillow may include a method of reducing transmission of ambient sound to a person with a pillow by configuring a foam pillow to include a head support portion for providing pliable support to at least a back of a person's head and a noise reducing surround portion for fitting to the sides and top of a person's head when the person's head is positioned in the head support portion, wherein the noise reducing surround portion makes intimate contact with at least the person's ears. Such a foam pillow may comprise memory foam.

Methods and systems for reducing ambient sound from reaching a person with a pillow may include a pillow for supporting a person's head while reducing transmission of ambient noise to a person's ears that has a base surface for disposing the pillow on a resting surface, a base panel for providing pliable support to a back of a head of a person reclining on the resting surface, an ambient sound isolation portion comprising opposing top and bottom surfaces, a head cradling surface that extends from the top to the bottom surfaces and forms a shape suitable for loosely conforming to sides and top of a human head, and an outer surface extending from the top to the bottom surfaces defining an extent of the ambient sound isolation portion, the ambient sound isolation portion contained within a volume defined by the opposing top and bottom surfaces, the head cradling surface and the outer surface, and a head cradling region, for accepting a head of the reclining person, defined as an open area above the base panel that is adjacent to the head cradling surface so that the base panel and the ambient sound isolation portion cover the back, sides, and top of the reclining person's head. This one-piece pillow may comprise memory foam. It may further include recesses in the head-cradling surface disposed to facilitate placing earphones in close proximity to the person's ears. In general the ambient sound-isolating portion forms a sound-reducing barrier between the reclining person's ears and the ambient. This pillow may further include recesses in the outer surface of the ambient sound isolation portion configured for disposing loudspeakers to facilitate propagating sound from the loudspeakers to the reclining person's ears through the ambient sound isolation portion. In this embodiment, the ambient sound isolation portion may comprise pliable foam.

The pillow may be constructed by integrating the ambient sound isolation portion with the base to form a one-piece pillow.

The head-cradling region may be sized to accommodate a reclining child, adolescent, and a range of adults.

These and other systems, methods, objects, features, and advantages of the present invention will be apparent to those skilled in the art from the following detailed description of the preferred embodiment and the drawings.

All documents mentioned herein are hereby incorporated in their entirety by reference. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context.

BRIEF DESCRIPTION OF THE DRAWINGS

For a more complete understanding of the present invention, reference is now made to the following descriptions taken in conjunction with the accompanying drawing, in which.

DETAILED DESCRIPTION

Figure 1:
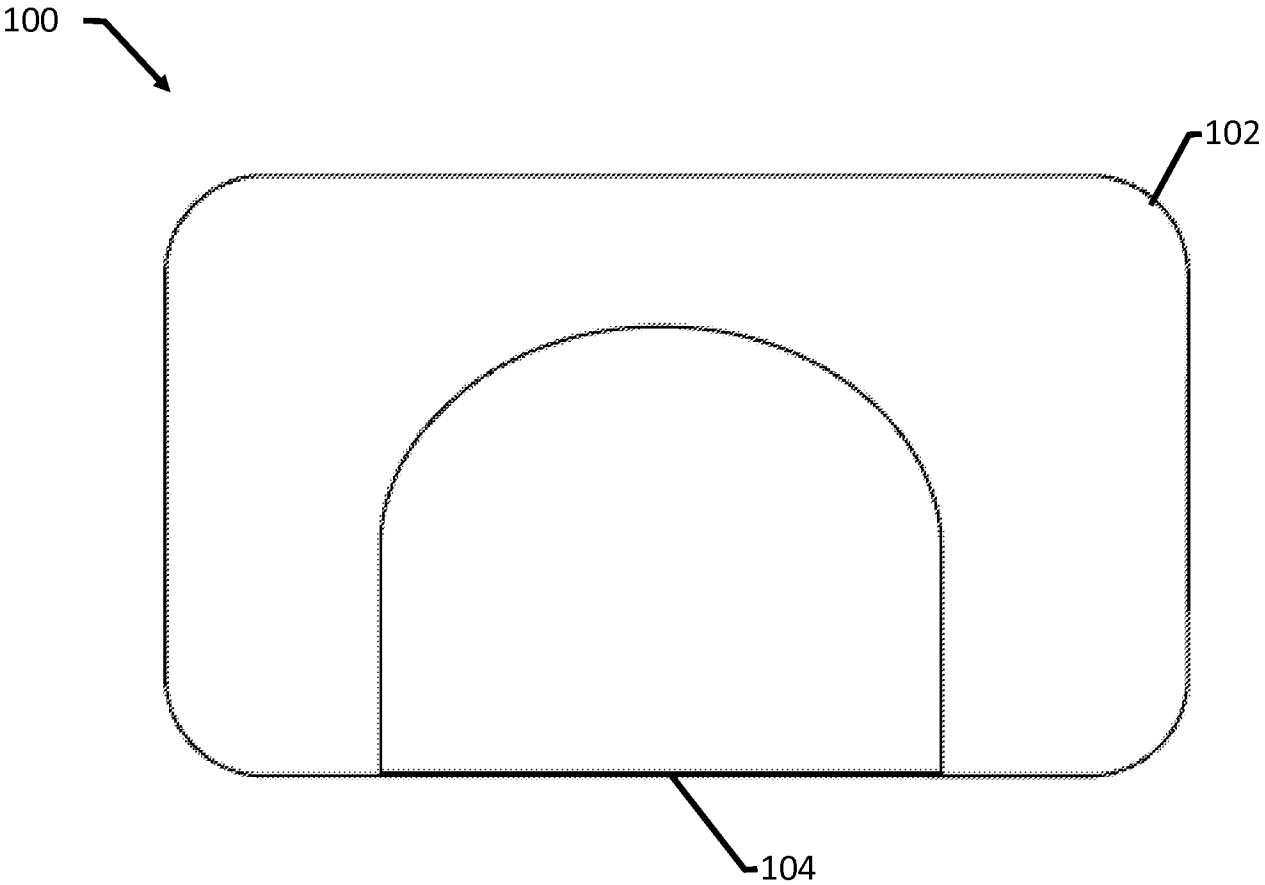
FIG. 1 depicts a top planar view of a sound-isolating pillow with a head cradling portion.

FIG. 1 depicts a top view of a sound-isolating one-piece pillow (100) comprised of pliable, foam (e.g. memory foam, latex foam, and the like). From this view, the pillow (100) may be substantially rectangular with approximately a 2:3 ratio in depth and width. The corners of the pillow (100) may be slightly rounded. A hollow portion of the pillow is formed (e.g. carved out, molded, or otherwise removed), creating a cradle for supporting a resting person's head (104). From the perspective view of FIG. 1, this head support portion (104) may be substantially centered along the width of the pillow and begins at about one-fourth of the width of the pillow (100) and extends to about three-fourths of the width of the pillow (100). The head support portion (104) extends into the depth of the pillow substantially perpendicularly to a front surface to about the mid-depth of the pillow and then creates an arch that extends further in depth while forming a top curvilinear surface to cradle the top of a person's head. The arch of the head support portion peaks at about three-fourth the depth of the pillow (100). The head-cradling region (104) may be sized to accommodate a reclining child. Alternatively, the head-cradling region (104) may be sized to accommodate a reclining adult.

The ambient sound-isolating portion (102) may be comprised of opposing top and bottom surfaces, a head cradling surface described above as the "top curvilinear surface" that extends from the top to the bottom surfaces and forms a shape suitable for loosely conforming to the sides and top of a human head, and an outer surface also extending from the top to the bottom surfaces. The sound-isolating portion (102) may be comprised of a single formation of pliable foam, and forms a sound-reducing barrier between a person's ears and the ambient. Alternatively, the sound-isolating portion (102) may be a composite of materials, such as a combination of foam, latex, and the like that may be assembled as a single formation.

Figure 2:
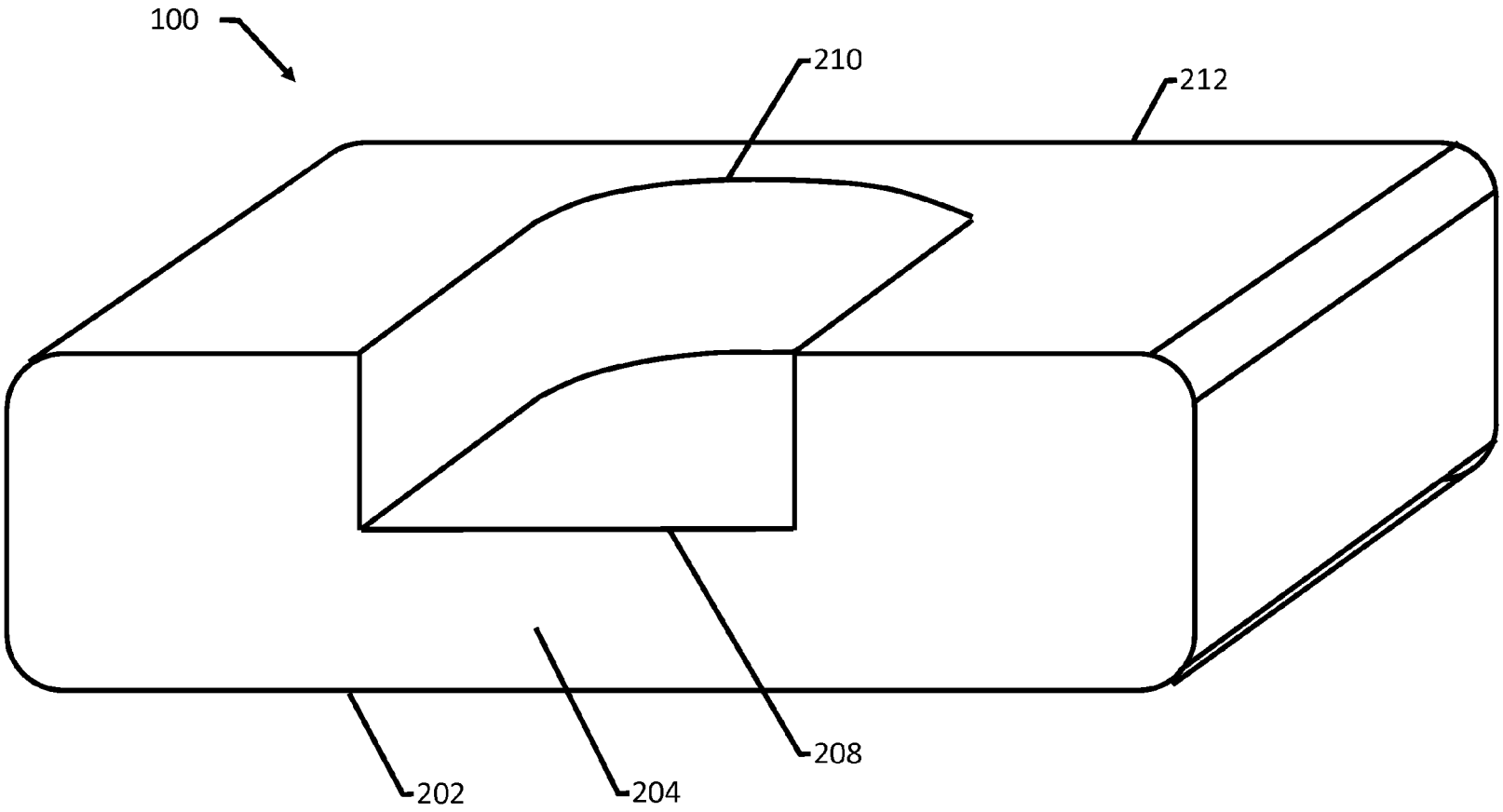
FIG. 2 depicts a front perspective view of the sound-isolating pillow.

FIG. 2 depicts the front perspective view of the ambient sound-isolating one-piece pillow (100) as though the sound-isolating pillow were lying flat on a base or bottom surface of the pillow (202) with a resting surface (208) and front surface of a bottom panel (204) of the head support facing toward the viewer. The bottom surface (202) facilitates disposing the pillow on a resting surface. The bottom panel (204) of the head support provides pliable support to a back of a head of a person reclining on the resting surface (208). The bottom panel (204) and the ambient sound isolation portion may be integrated to form a one-piece pillow. From this angle, the viewer can see that the head support portion may comprise a pliable resting surface (208) for resting the back of a persons head with a curvilinear upper surface (210) that is substantially orthogonal to the resting surface (208) for cradling at least the sides of a person's head.

The height of the head support portion is about half the height of the pillow. The upper surface of the pillow (212) and the resting surface (208) may be substantially parallel to the base/bottom surface (202). Alternatively, the upper surface of the pillow (212) may not be substantially parallel to the bottom surface (202). Yet alternatively, the upper surface (212) may be non-planar.

Figure 3:
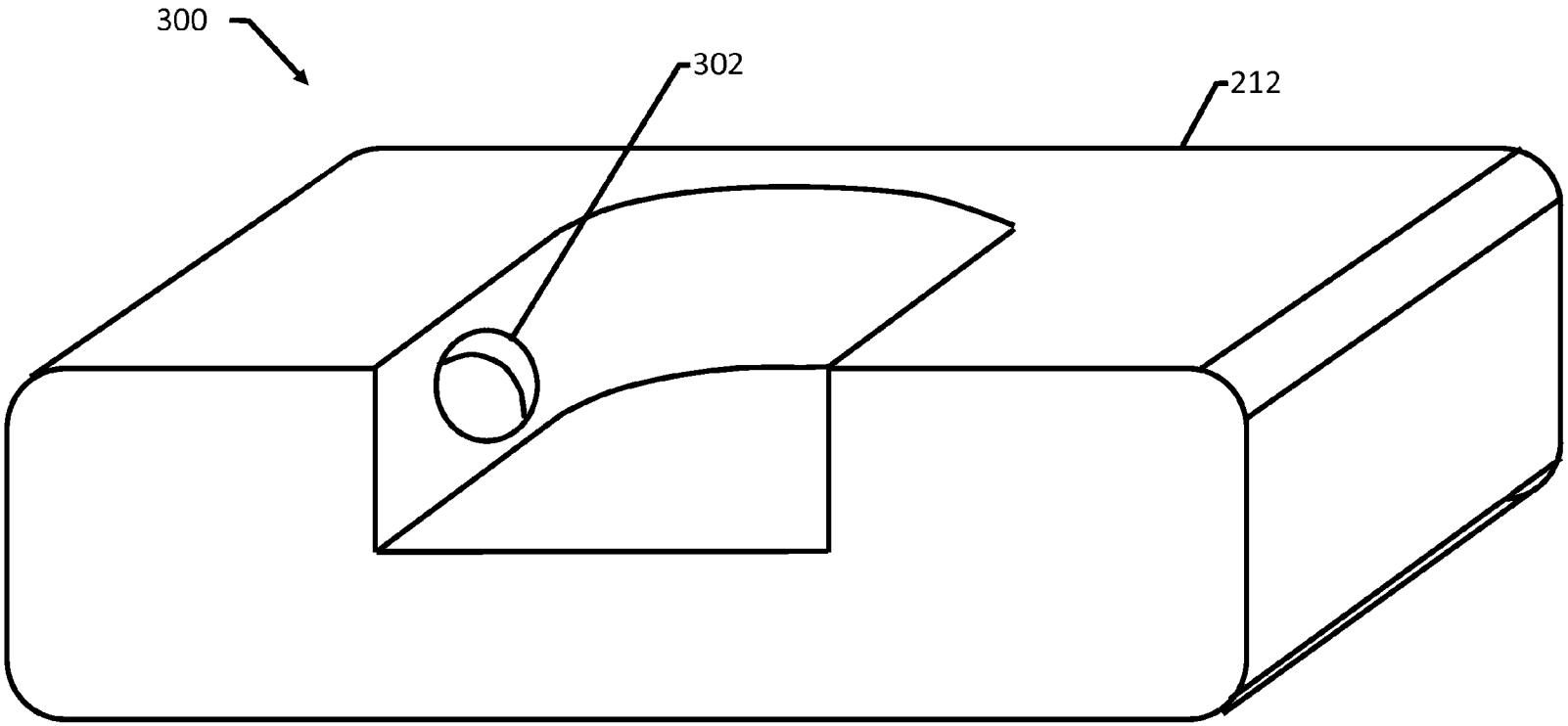
FIG. 3 depicts a front perspective view of the sound-isolating pillow adapted to support earphones.

FIG. 3 depicts a front perspective view of an earphone-compatible sound-isolating pillow (300) that may be substantially described as the same sound-isolating one-piece pillow comprising pliable foam described in FIGS. 1 and 2. However, the embodiment of FIG. 3 includes at least one earphone recess (302) that may be disposed in one or more of the surfaces of the head support portion (104) (e.g. the curvilinear upper surface (210)) to facilitate locating earphones in close proximity to the person's ears. In this way, a user may listen to audio from the earphones while resting with his head in the head support portion (104) that may include a pliable panel that facilitates cradling the back of a person's head and further eliminate the ambient sound from negatively affecting the person's listening experience.

Figure 4:
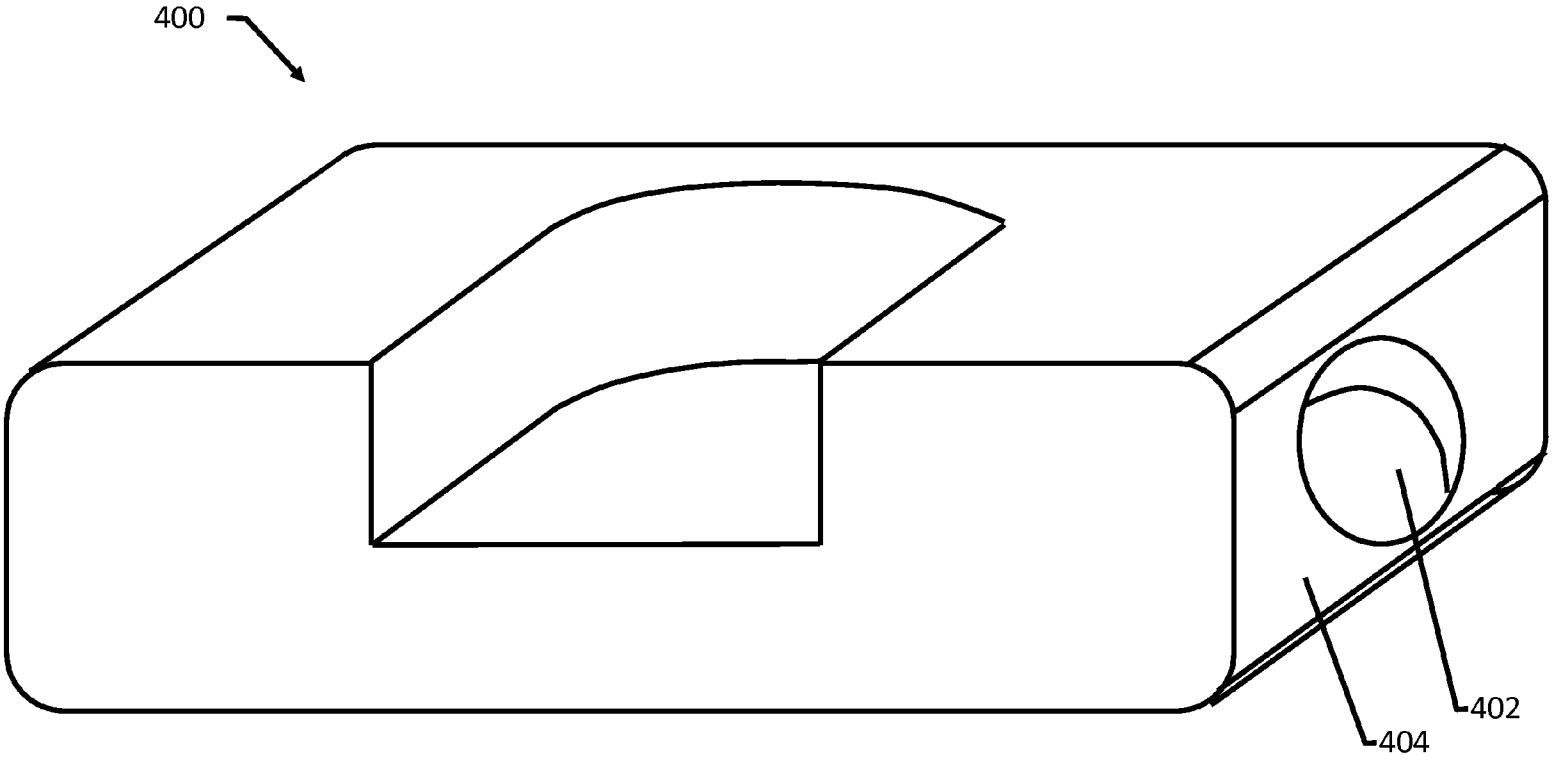
FIG. 4 depicts a front perspective view of the sound-isolating pillow adapted to support loudspeakers.

FIG. 4 depicts a front perspective view of a loudspeaker compatible ambient sound-isolating pillow (400) that may be described as the same sound-isolating one-piece pillow described in FIGS. 1 and 2, except that the embodiment depicted in FIG. 4 includes at least one loudspeaker recess (402). The loudspeaker recess (402) may be formed in an outer surface of the sound-isolating portion, such as a side surface (404). The loudspeaker recess(es) (402) may be configured for disposing loudspeakers to facilitate propagating sound from the loudspeakers to the person's ears through the sound-isolating portion comprised of a single formation of pliable foam. In this way, a user could listen to audio from the loudspeakers while resting with her head in the head support portion (104) that may include a pliable panel that facilitates cradling the back of a person's head and further eliminate the ambient sound from negatively affecting the person's listening experience.

The ambient sound-isolating pillow (100) may be used by individuals when sleeping in a bed. Light sleepers or individuals staying in a noisy dorm room, in a house full of noisy children/people/sounds, or individuals needing or wanting to rest during the day when outside noise may make it difficult to find silence may find the ambient sound-isolating pillow (100) especially useful. Though especially beneficial for individuals desiring to reduce ambient noise when sleeping, the ambient sound-isolating pillow is useful for any individual who uses a pillow when resting or sleeping. The pillow, made of pliable foam, may provide support to the neck and head of the reclining person so as to promote comfort and rest. Further, the sound-isolating pillow (100) does not require electricity and because it may be integrated as a one-piece pillow, it may thus be useful for individuals needing to sleep or rest while traveling (in a car, plane, train, bus, etc.), camping, or otherwise.

The benefits of the ambient sound-isolating pillow (100) are numerous. The pillow reduces or substantially eliminates ambient noise from disturbing the person resting on the pillow. The pillow is simple to use: the individual simply needs to place his or her head on the head support portion. There are no straps, mechanisms, or contraptions involved. When used with the loudspeakers, soothing sounds or a person's favorite bedtime music or song can be output from the loudspeakers so that the pillow user hears this music rather than ambient noise. Although the noise-isolating portion is effective at reducing ambient noise, it may also be very good at transmitting sounds from the loudspeakers placed in the loudspeaker recesses to the person using the pillow. Alternatively, the pillow user may listen to the same soothing sounds or music using earphones through the earphone recesses. This option may be beneficial if the pillow user does not want to disrupt others who may be resting nearby but are not using the sound-isolating pillow (100).

I claim:

1. A sound-isolating pillow comprising:

a head support portion that is shaped to cradle the back and sides of a head of a person; and a sound-isolating portion disposed relative to the head support portion to facilitate shielding at least the ears of the person from ambient sound, wherein the head support portion and the sound-isolating portion are integrated into a one-piece pillow.

2. The sound-isolating pillow of claim 1, wherein the one-piece pillow comprises memory foam.

3. The sound-isolating pillow of claim 1, wherein the head support portion comprises a pliable surface for resting the back of a person's head and a curvilinear upper surface that is substantially orthogonal to the pliable surface for cradling at least the sides of a person's head.

4. The sound-isolating pillow of claim 3, further including recesses in the curvilinear upper surface disposed to facilitate placing earphones in close proximity to the person's ears.

5. The sound-isolating pillow of claim 3, wherein the sound-isolating portion comprises a region that extends outward from the upper surface of the head support portion and forms a sound-reducing barrier between a person's ears and the ambient.

6. The sound-isolating pillow of claim 5, further including recesses in an outer surface of the sound-isolating portion that is opposite the upper surface, the recesses configured for disposing loudspeakers to facilitate propagating sound from the loudspeakers to the person's ears through the sound-isolating portion.

7. The sound-isolating pillow of claim 1, wherein the sound-isolating portion comprises pliable foam.

8. The sound-isolating pillow of claim 1, wherein the one-piece pillow is constructed by integrating the sound-isolating portion with a pliable panel that facilitates cradling the back of a person's head.

9. The sound-isolating pillow of claim 1, wherein the sound-isolating portion comprises a single formation of pliable foam.

10. A method of reducing transmission of ambient sound to a person with a pillow, comprising:

configuring a foam pillow to include a head support portion for providing pliable support to at least a back of a person's head and a noise reducing surround portion for fitting to the sides and top of a person's head when the person's head is positioned in the head support portion, wherein the noise reducing surround portion makes intimate contact with at least the person's ears.

11. The method of claim 10, wherein the foam pillow comprises memory foam.

12. A pillow for supporting a person's head while reducing transmission of ambient noise to a person's ears, comprising:

a bottom surface for disposing the pillow on a resting surface;

a base panel for providing pliable support to a back of a head of a person reclining on the resting surface;

an ambient sound isolation portion comprising opposing top and resting surfaces, a head cradling surface that extends from the top to the resting surface and forms a shape suitable for loosely conforming to sides and top of a human head, and an outer surface extending from the top to the resting surface defining an extent of the ambient sound isolation portion, the ambient sound isolation portion contained within a volume defined by the opposing top and resting surfaces, the head cradling surface and the outer surface; and a head cradling region, for accepting a head of the reclining person, defined as an open area above the base panel that is adjacent to the head cradling surface so that the base panel and the ambient sound isolation portion cover the back, sides, and top of the reclining person's head.

13. The pillow of claim 12, wherein the one-piece pillow comprises memory foam.

14. The pillow of claim 12, further including recesses in the head cradling surface disposed to facilitate placing earphones in close proximity to the person's ears.

15. The pillow of claim 12, wherein the ambient sound-isolating portion forms a sound-reducing barrier between the reclining person's ears and the ambient.

16. The pillow of claim 12, further including recesses in the outer surface of the ambient sound isolation portion configured for disposing loudspeakers to facilitate propagating sound from the loudspeakers to the reclining person's ears through the ambient sound isolation portion.

17. The pillow of claim 12, wherein the ambient sound isolation portion comprises pliable foam.

18. The pillow of claim 12, wherein the pillow is constructed by integrating the ambient sound isolation portion with the base to form a one-piece pillow.

19. The pillow of claim 12, wherein the head-cradling region is sized to accommodate a reclining child.

20. The pillow of claim 12, wherein the head-cradling region is sized to accommodate a reclining adult.

* * * * *